US007306034B2

(12) United States Patent
Garcia

(10) Patent No.: US 7,306,034 B2
(45) Date of Patent: Dec. 11, 2007

(54) GRIPPING ASSEMBLY FOR EXPANDABLE TUBULARS

(75) Inventor: David A. Garcia, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 237 days.

(21) Appl. No.: 11/206,692

(22) Filed: Aug. 18, 2005

(65) Prior Publication Data

US 2007/0039161 A1 Feb. 22, 2007

(51) Int. Cl.
*E21B 23/00* (2006.01)

(52) U.S. Cl. ..... 166/206; 166/387; 277/334

(58) Field of Classification Search ..... 166/387, 166/120, 196, 212, 206; 92/53, 91; 277/334, 277/331; 285/351, 370
See application file for complete search history.

(56) References Cited

U.S. PATENT DOCUMENTS 2,670,797 A * 3/1954 Armentrout ..... 166/136
2,898,136 A * 8/1959 Hall, Sr. et al. ..... 403/6
3,412,803 A * 11/1968 Stachowiak ..... 166/134
4,413,653 A 11/1983 Carter, Jr.
4,424,861 A 1/1984 Carter, Jr. et al.
4,441,561 A 4/1984 Garmong
4,749,035 A 6/1988 Cassity
4,892,144 A 1/1990 Coone
5,220,959 A 6/1993 Vance, Sr.
5,242,451 A * 9/1993 Harada et al. ..... 623/1.18
5,494,106 A * 2/1996 Gueguen et al. ..... 166/277
5,542,473 A 8/1996 Pringle et al.
6,098,717 A 8/2000 Bailey et al.
6,513,600 B2 2/2003 Ross
6,793,022 B2 * 9/2004 Vick et al. ..... 166/382

* cited by examiner

*Primary Examiner*—David Bagnell
*Assistant Examiner*—Daniel P Stephenson
(74) *Attorney, Agent, or Firm*—Steve Rosenblatt

(57) ABSTRACT

Grip between a tubular being expanded and the surrounding tubular is enhanced by disposing a wire in a groove. The wire is preferably harder than the surrounding tubular so that it can dig in upon expansion. The wire is mounted in the groove so that it is not stretched due to the expansion and for that reason doesn't increase the effort required for the expansion. The wire can take the shape of the groove that it is in or it can have some other shape. The wire can be solid or hollow and can be in segments such as rings or can be a longer continuously extending wire in a groove that, for example, can be helically disposed on the tubular being expanded or even on a sleeve surrounding it.

25 Claims, 1 Drawing Sheet

GRIPPING ASSEMBLY FOR EXPANDABLE TUBULARS

FIELD OF THE INVENTION

The field of this invention relates to gripping devices to enhance grip of expanded tubulars against a surrounding tubular and more particularly to situations where there a tight clearances before expansion.

BACKGROUND OF THE INVENTION

In what has now become a common technique a tubular string is expanded into a supporting relationship into a surrounding tubular by employing a swage driven in either an uphole of downhole direction. Other devices are also employed to perform the expansion. Frequently, steps are taken to enhance the nature of the grip between the expanded tubular and the surrounding tubular. In the past, this had been accomplished by the addition of threads to an end of the tubular to be expanded and the heat treating of that threaded zone while being careful not to treat the adjacent non-expanded zone. This technique had associated cost issues and had to be carefully executed to avoid creating situations that could result in failure of the expanded tubular. Alternatives that had been tried to an external thread on the tubular to be expanded by using a split ring but the small thicknesses that needed to be used due to low clearances during run in made it difficult to heat treat these rings without significant warping.

In the past, resilient seals were put in exterior grooves of sleeves mounted over a tubular to be expanded to minimize required expansion and to enhance the sealing contact after such expansion. One example of this technique is U.S. Pat. No. 6,098,717. This design was not directed at enhancing grip as much as improving the sealing contact after expansion. Other techniques that used traditional slip type structures on the exterior of the tubing to be expanded were limited in applicability to situations that involved substantial clearances during run in, making them impractical when close clearances were present.

What is needed and addressed by the present invention was a technique that could enhance grip in an expansion situation without increasing the force required to expand and be workable in a tight clearance environment. Another desirable feature for such a system is to eliminate the costs associated with the prior designs for heat treating. Accordingly, a variety of executions of the invention are described that feature a wire or wire-like material that can be solid or hollow and that is disposed and can be retained in a groove where the material is preferably harder than the two tubulars brought together during expansion and is so mounted that it need not be stretched or expanded with the inner tubular. These and other aspects of the invention will be more readily apparent to a person skilled in the art from a review of the description of the preferred embodiment and the claims that appear below.

SUMMARY OF THE INVENTION

Grip between a tubular being expanded and the surrounding tubular is enhanced by disposing a wire in a groove. The wire is preferably harder than the surrounding tubular so that it can dig in upon expansion. The wire is mounted in the groove so that it is not stretched due to the expansion and for that reason doesn't increase the effort required for the expansion. The wire can take the shape of the groove that it is in or it can have some other shape. The wire may skip grooves and the groove may provide various resistances to the wire/groove conforming to each other. The wire may reside at different depth levels before and after expansion. The wire can be solid or hollow and can be in segments such as rings or can be a longer continuously extending wire in a groove that, for example, can be helically disposed on the tubular being expanded or even on a sleeve surrounding it.

DETAILED DESCRIPTION OF THE DRAWINGS

DETAILED DESCRIPTION OF THE PREFERRED EMBODIMENT

Figure 1:
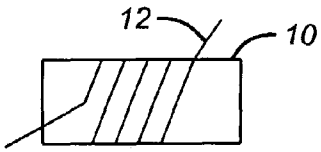
FIG. 1 shows the use of a spirally wound wire on the outside of the body to be expanded.
Figure 2:
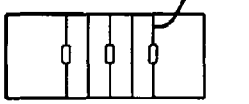
FIG. 2 shows the use of discrete parallel wire rings.

FIGS. 1 and 2 show alternative layouts of wire wrapped around a body 10 to be expanded. As used herein "wire" means product extruded to a specific cross-sectional shape or shapes that can be applied to a body 10 in its manufactured form as opposed to an elongated shape that is machined into that form. In FIG. 1 the wire 12 is spirally wound in a groove such as 14 shown in FIG. 4. The shape of groove 14 can be varied, as shown in the other Figures and the shape of the wire 12 can also be varied accordingly. The wire 12 can be solid or hollow. Alternatively, groove 14 need not be used at all and the wire 12 can simply be wrapped on the outer surface of the body 10 that is to be expanded using techniques well known in the art. It is desirable to have the wire harder than the tubular into which it will be expanded so that upon expansion it will dig into that surface to enhance the connection between the expanded tubular and its surrounding tubular. Additionally, it is also desirable to have the wire 12 harder than body 10 so that upon expansion, and if groove 14 is used, the wire 12 will also dig into the groove 14. This not only enhances the support provided by the connection but also improves the sealing quality of that connection. Of course, if no groove 14 is used, the wire 12 will simply penetrate the body 10 being expanded.

Note that in FIG. 1 the helical wrap is loose, so that upon expansion of the body 10 the wire 12 is not elongated and preferably not even tensioned. Either phenomenon would increase the expansion force required and could also snap the wire 12. It should further be noted that the wire 12 in FIG. 1 is shown as continuous but it can also be in segments and still achieve the enhanced gripping. The advantage of the systems in FIGS. 1 and 2 is that they have very low profiles and thus can be used in situations that have minimal clearance during run in to enhance the final grip after expansion.

Figure 12:
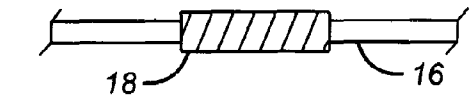
FIG. 12 is a view of a spring that holds a loop of the wire.
Figure 13:
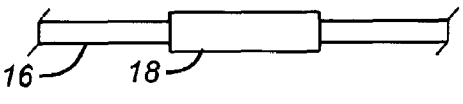
FIG. 13 shows an elastomer bond for ends of a wire to hold it in place.

FIG. 2 illustrates the use of individual rings 16 that may be parallel to each other or not. Each ring 16 can be held with a closure 18 that can be a spring, illustrated in FIG. 12 or an elastomer band or band made from some other resilient material, as shown in FIG. 13.

Figure 3:
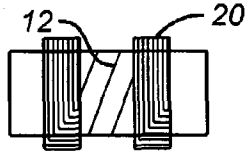
FIG. 3 is the view of FIG. 1 using elastomer bands to hold the wire for expansion.

As an alternative, whether rings 16 are used or a winding as shown in FIG. 1, bands 20 can be an overlay to hold the wire 12 as illustratively shown in FIG. 3. Expansion will force the wire 12 through the bands 20 to allow the wires 12 to get an appropriate bite into a surrounding tubular upon expansion as well as into the supporting tubular 10.

Figure 4:
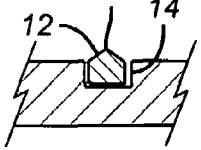
FIG. 4 is a section through a groove showing the use of pentagon-shaped solid wire.
Figure 5:
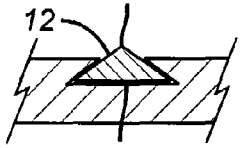
FIG. 5 shows a solid triangularly shaped wire in a dovetail.
Figure 6:
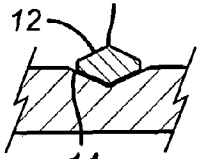
FIG. 6 shows a diamond shaped solid wire in a v-shaped slot.
Figure 7:
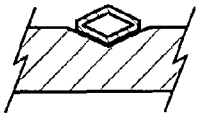
FIG. 7 is the view of FIG. 6 using a hollow wire.
Figure 8:
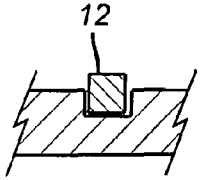
FIG. 8 shows a square solid wire in a rectangular slot.
Figure 9:
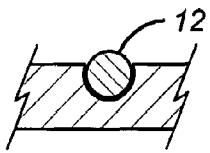
FIG. 9 shows a rounded solid wire dovetailed in a rounded slot.
Figure 10:
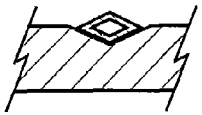
FIG. 10 is the view of FIG. 6 using a hollow wire.
Figure 11:
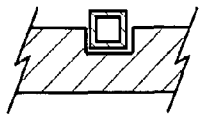
FIG. 11 is the view of FIG. 8 using a hollow wire.

FIGS. 4-11 illustrate a few alternatives to the shape of the groove 14 or the wire 12. In FIG. 4 that groove is square or rectangular and the wire has a pentagonal cross-section coming to a point 22. In FIG. 5 the wire 12 has a triangular cross-section and is held in a dovetail groove 14 that matches the cross-section and retains the wire 12 in the groove 14. In FIG. 6 the wire 12 has a diamond cross-section and the groove 12 is a v-shape to conform to it. Again there is a point 22 to dig into the surrounding tubular. FIGS. 7 and 10 are similar to FIG. 6 except the wire 12 has a hollow cross-section. In FIG. 8 the wire 12 is square or rectangular and solid in cross-section. In FIG. 9, the wire 12 is round and the groove 14 is a truncated round section to match and to retain the wire 12 in the groove 14. FIG. 11 is similar to FIG. 8 except the wire 12 is hollow in cross-section.

Figure 14:
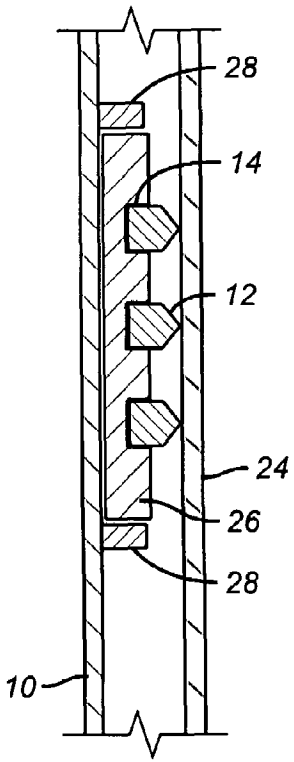
FIG. 14 is a section showing the use of a wire in grooves in a sleeve that surrounds the tubular to be expanded.

FIG. 14 shows a tubular to be expanded into a surrounding tubular 24. The wire 12 is in groove 14 but this time the groove 14 is located on a split ring 26 that is secured in known ways 28 to the tubular 10. The ring 26 is split so that it need not be deformed during the expansion of the tubular 10. Again, the wire is not elongated during expansion so that it does not add to the force required to expand the tubular 10. For these reasons the ring 26 requires no heat treating and can be deployed in situations with fairly low run in clearance. It should be noted that any of the designs illustrated in the Figures can be deployed with a separate ring as illustrated in FIG. 14 or as previously described by putting the wire 12 right on the outside of the tubular 10 or in grooves 14 in the tubular 10. The grooves or wire can alternatively be placed on the surrounding tubular but that is more logistically difficult as the exact location for support of another tubular expanded from within has to be figured out in advance of running the outer tubular.

Those skilled in the art will now appreciate that the variety of designs allow enhanced grip in run in situations with minimal clearance. The heat treating required in prior designs that expanded threads is eliminated. The designs can be presented in a variety of embodiments to meet the specific situation. The wire can be mounted directly to the outer surface of the tubular to be expanded or in grooves in the outer surface. The wire preferably is harder than its surrounding tubulars so that it will penetrate into them upon expansion. The wire can be continuous or segmented and in either form the wire is placed in a manner where it will offer minimal if any resistance to the expansion of the inner tubular. The shape of the wire can conform to the shape of a surrounding groove and the two can be tailored to have a dovetail effect to retain the wire in the surrounding groove for run in and during the subsequent expansion. The wire ends can be secured to each other with springs or elastic members to accommodate radial expansion of the tubular within. Alternatively, a continuous wire or segments can be retained with bands that give with radial expansion wherein the wire can penetrate the band on expansion to obtain the desired grip on the inner and outer tubulars. The wire may have a twist along its length and the shape can also vary along the length.

The above description is illustrative of the preferred embodiment and many modifications may be made by those skilled in the art without departing from the invention whose scope is to be determined from the literal and equivalent scope of the claims below:

I claim:

1. A method of securing a pressure conducting inner tubular to a pressure conducting outer tubular, comprising:
positioning the inner tubular inside the outer tubular;
locating an elongated member comprising a wire between said tubulars;
providing a groove in one of said tubulars to retain said wire;
expanding said inner tubular beyond its original cylindrical dimension in the region where said elongated member is disposed; and
driving said elongated member into at least one of said tubulars from said expanding.

2. The method of claim 1, comprising:
driving said elongated member into both said tubulars from said expanding.

3. The method of claim 1, comprising:
loosely mounting said elongated member so as to permit relative movement during said expanding.

4. The method of claim 3, comprising:
forming said elongated member of a material harder than at least one of said tubulars.

5. The method of claim 4, comprising:
disposing said elongated member in a groove on one of said tubulars;
forming said groove to take the shape of said elongated member.

6. The method of claim 5, comprising:
shaping said groove to provide a dovetail effect to retain said elongated member at least in part within said groove.

7. The method of claim 5, comprising:
disposing said elongated member in a plurality of rings.

8. The method of claim 5, comprising:
providing one of a solid and hollow cross-section for said elongated member.

9. The method of claim 8, comprising:
providing one of a triangle, circle, quadrilateral or polygon cross section to said elongated member.

10. The method of claim 5, comprising:
positioning a sleeve on said inner tubular;
locating said elongated member on said sleeve.

11. The method of claim 1, comprising:
forming said elongated member of a material harder than at least one of said tubulars.

12. The method of claim 1, comprising:
shaping said groove to provide a dovetail effect to retain said elongated member at least in part within said groove.

13. The method of claim 1, comprising:
disposing said elongated member in a spiral pattern.

14. The method of claim 1, comprising:
disposing said elongated member in a plurality of rings.

15. The method of claim 1, comprising:
providing one of a solid and hollow cross-section for said elongated member.

16. The method of claim 15, comprising:

providing one of a triangle, circle, quadrilateral or polygon cross section to said elongated member.

17. The method of claim 16, comprising:

providing a twist on at least a portion of the length of said elongated member.

18. The method of claim 1, comprising:

positioning a sleeve on said inner tubular;

locating said elongated member on said sleeve.

19. The method of claim 1, comprising:

disposing said elongated member in a groove on one of said tubulars;

forming said groove to take the shape of said elongated member.

20. A method of securing an inner tubular to an outer tubular, comprising:

positioning the inner tubular inside the outer tubular;

locating an elongated member comprising a wire between said tubulars;

expanding said inner tubular in the region where said elongated member is disposed;

driving said elongated member into at least one of said tubulars from said expanding;

disposing said elongated member in a plurality of rings;

closing at least one of said rings with a flexible closure that accommodates circumferential elongation.

21. A method of securing an inner tubular to an outer tubular, comprising:

positioning the inner tubular inside the outer tubular;

locating an elongated member comprising a wire between said tubulars;

expanding said inner tubular in the region where said elongated member is disposed;

driving said elongated member into at least one of said tubulars from said expanding;

loosely mounting said elongated member so as to permit relative movement during said expanding;

forming said elongated member of a material harder than at least one of said tubulars;

disposing said elongated member in a groove on one of said tubulars;

forming said groove to take the shape of said elongated member;

disposing said elongated member in a spiral pattern.

22. A method of securing an inner tubular to an outer tubular, comprising:

positioning the inner tubular inside the outer tubular;

locating an elongated member comprising a wire between said tubulars;

expanding said inner tubular in the region where said elongated member is disposed;

driving said elongated member into at least one of said tubulars from said expanding;

loosely mounting said elongated member so as to permit relative movement during said expanding;

forming said elongated member of a material harder than at least one of said tubulars;

disposing said elongated member in a groove on one of said tubulars;

forming said groove to take the shape of said elongated member;

disposing said elongated member in a plurality of rings;

closing at least one of said rings with a flexible closure that accommodates circumferential elongation.

23. A method of securing an inner tubular to an outer tubular, comprising:

positioning the inner tubular inside the outer tubular;

locating an elongated member comprising a wire between said tubulars;

expanding said inner tubular in the region where said elongated member is disposed;

driving said elongated member into at least one of said tubulars from said expanding;

providing one of a solid and hollow cross-section for said elongated member;

providing one of a triangle, circle, quadrilateral or polygon cross section to said elongated member;

a twist on at least a portion of the length of said elongated member;

providing a plurality of said shapes on at least a portion of the length of said elongated member.

24. A method of securing a pressure conducting inner tubular to a pressure conducting outer tubular, comprising:

positioning the inner tubular inside the outer tubular;

locating an elongated member between said tubulars;

disposing said elongated member in a groove on one of said tubulars;

expanding said inner tubular beyond its original cylindrical dimension in the region where said elongated member is disposed; and driving said elongated member into at least one of said tubulars from said expanding.

25. The method of claim 24, comprising:

forming said groove to take the shape of said elongated member.

* * * * *